United States Patent [19]

Vanier et al.

[11] Patent Number: 4,700,207

[45] Date of Patent: Oct. 13, 1987

[54] CELLULOSIC BINDER FOR DYE-DONOR ELEMENT USED IN THERMAL DYE TRANSFER

[75] Inventors: Noel R. Vanier, Rochester, N.J.; Kin K. Lum, Webster, N.Y.

[73] Assignee: Eastman Kodak Company, Rochester, N.Y.

[21] Appl. No.: 918,426

[22] Filed: Oct. 14, 1986

Related U.S. Application Data

[63] Continuation-in-part of Ser. No. 813,166, Dec. 24, 1985, abandoned.

[51] Int. Cl.[4] ..... B41M 5/26

[52] U.S. Cl. ..... 503/227; 8/471; 427/146; 427/256; 428/195; 428/480; 428/481; 428/532; 428/536; 428/913; 428/914; 430/945

[58] Field of Search ..... 8/470, 471; 428/195, 428/207, 488.1, 488.4, 913, 914, 481, 508, 532, 536, 480, 484; 430/945; 346/227; 427/146, 256

FOREIGN PATENT DOCUMENTS 199295 11/1984 Japan ..... 346/227
153880 4/1985 European Pat Appln. ..... 8/471

[56] References Cited

U.S. PATENT DOCUMENTS 4,555,427 11/1985 Kauasaki et al. ..... 428/195
4,559,273 12/1985 Kutsukake et al. ..... 8/471

*Primary Examiner*—Bruce H. Hess
*Attorney, Agent, or Firm*—Harold E. Cole

[57] ABSTRACT

A dye-donor element for thermal dye transfer comprises a support having thereon a dye layer comprising a dye dispersed in a binder of cellulose triacetate or a cellulose mixed ester, such as cellulose acetate butyrate wherein the butyryl content is less than about 35% or the acetyl content is less than about 2% or both, or cellulose acetate hydrogen phthalate.

20 Claims, No Drawings

CELLULOSIC BINDER FOR DYE-DONOR ELEMENT USED IN THERMAL DYE TRANSFER

This is a continuation-in-part of Ser. No. 813,166, filed Dec. 24, 1985, now abandoned.

This invention relates to dye-donor elements used in thermal dye transfer, and more particularly to the use of certain cellulosic binders to provide improved dye transfer densities.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

In a thermal dye transfer system, the background density is essentially constant. Any increase in density of the transferred dye in image areas results in improved discrimination which is highly desirable.

In Japanese laid open publication No. 59/199295, a dye donor element is described which employs a binder of a mixture of polystyrene and cellulose acetate. The polystyrene is added in order to improve the transfer of dye. It would be desirable to provide a cellulosic binder for a dye donor element without having to add another polymer to it.

In European patent application No. 153,880, a heat transfer sheet is described which employs a binder resin for a sublimable dye which includes various vinyl resins and cellulose resins. Among the cellulose resins disclosed is cellulose acetate butyrate. No specific cellulose acetate butyrate examples are given, however.

It has been found that certain cellulose acetate butyrates act to promote dye crystallization. Dye crystallization in the dye-donor element is very undesirable since it prevents effective thermal dye transfer, producing low and erratic print densities. It would be desirable to provide a dye-donor element wherein the binder produces little or no dye crystallization.

Thus, in accordance with this invention, a dye donor element for thermal dye transfer is provided which comprises a support having thereon a dye layer comprising a dye dispersed in a binder of cellulose triacetate (fully acetylated) or a cellulose mixed ester, with the proviso that when the cellulose mixed ester is cellulose acetate butyrate, it has a butyryl content of less than about 35% or an acetyl content of less than about 2% or both.

In a preferred embodiment of the invention, the total esterification of the cellulose mixed ester is from about 40 to about 60%, with about 1–30% of said ester being acetyl and about 10–58% being other esterification.

In another preferred embodiment of the invention, the cellulose mixed ester is cellulose acetate hydrogen phthalate; cellulose acetate formate; cellulose acetate propionate; cellulose acetate pentanoate; cellulose acetate hexanoate; cellulose acetate heptanoate; cellulose acetate benzoate; or cellulose acetate butyrate having a butyryl content of less than about 35% or an acetyl content of less than about 2% or both; with cellulose triacetate, cellulose acetate hydrogen phthalate or the cellulose acetate butyrate as described being especially preferred.

The cellulosic binder of the invention may be employed at any concentration which is effective for the intended purpose. In general, good results have been obtained from about 0.1 to about 5 g/m$^2$ of coated element.

A dye-barrier layer may be employed in the dye-donor elements of the invention to improve the density of the transferred dye. Such dye-barrier layer materials include hydrophilic materials such as those described and claimed in Application Ser. No. 813,294 entitled "Dye-Barrier Layer for Dye-Donor Element Used in Thermal Dye Transfer" by Vanier, Lum and Bowman, filed Dec. 24, 1985.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (Product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

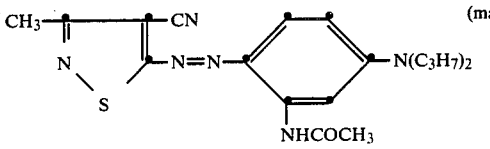

(magenta A)

-continued (yellow B)

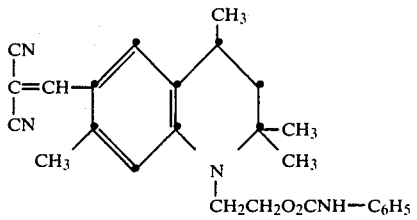

(cyan C)

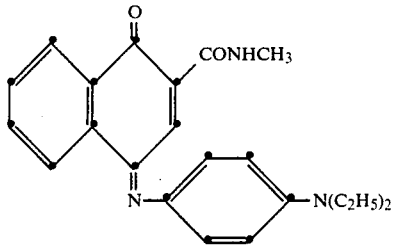

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic. The ratio of dye:cellulosic binder is from 1:2 to 1:5.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of about .001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl cholride, poly(styrene-coacrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form of in a continuous roll or ribbon. If a continuous roll or ribbon is employed, it may have only one dye thereon or may have alternating areas of different dyes, such as sublimable cyan, magenta, yellow, black, etc., as disclosed in U.S. Pat. No. 4,541,830. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rhom Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention. Example 1

A dye-donor element was prepared by coating the following layers in the order recited on a 6 μm poly(ethylene terephthalate) support:

(1) Dye-barrier layer of gelatin nitrate (gelatin, cellulose nitrate and salicylic acid in approximately 20:5:2 weight ratio in a solvent of acetone, methanol and water) (017 g/m$^2$), (2) Dye layer containing a dye as identified below and in a binder as identified in Table 1 below coated from an acetone/2-butanone/cyclohexanone solvent.

On the back side of the element was coated a slipping layer of the type described and claimed in U.S. Application Ser. No. 813,199 entitled "Slipping Layer For Dye-Donor Element Used In Thermal Dye Transfer" by Vanier and Harrison, filed Dec. 24, 1985.

A dye-receiving element was prepared by coating a solution of Makrolon 5705® (Bayer A. G.) polycarbonate resin (2.5 g/m$^2$) in a methylene chloride and trichloroethylene solvent mixture on an ICI Melines 990® white polyester support.

The dye side of the dye-donor element strip 0.75 inches (19 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a Fujitsu Thermal Head (FTP-040MCS001) and was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at 0.5 msec increments from 0 to 4.5 msec to generate a graduated density test pattern. The voltage supplied to the print head was approximately 19 v representing approximately 1.75 watts/dot. Estimated head temperature was 250°–400° C.

The assemblage was separated, the dye-donor element was discarded, and the dye transferred to the dye-receiver element was measured with an X-Rite 338 Color Reflection Densitomer® with Status A filters. The following results were obtained:

TABLE 1

| Dye (g/m$^2$) | | Binder (g/m$^2$) | | Status A D-Max |
|---|---|---|---|---|
| Controls | | | | |
| Magenta-A | 0.22 | Cellulose acetate | 0.38 | 1.5 (G) |
| Yellow-B | 0.27 | Cellulose acetate | 0.32 | 1.8 (B) |
| Cyan-C | 0.32 | Cellulose acetate | 0.39 | 1.5 (R) |
| Invention | | | | |
| Magenta-A | 0.22 | Cellulose acetate hydrogen phthalate | 0.38 | 2.0 (G) |
| Magenta-A | 0.22 | Cellulose triacetate | 0.38 | 2.1 (G) |
| Magenta-D | 0.26 | Cellulose acetate hydrogen phthalate | 0.38 | 2.0 (G) |
| Cyan-C | 0.37 | Cellulose acetate hydrogen phthalate | 0.23 | 1.8 (R) |
| Cyan-C | 0.32 | Cellulose acetate hydrogen phthalate | 0.39 | 1.7 (R) |

Binders

The cellulose acetate employed in the control examples was 39.8–40.0% acetyl. The cellulose acetate hydrogen phthalate was 19–23.5% acetyl and 30–36% phthalyl. The cellulose triacetate was 100% fully acetylated.

Dyes

Magenta dye A, Yellow dye B and Cyan dye C were identified above. Magenta dye D has the following structure:

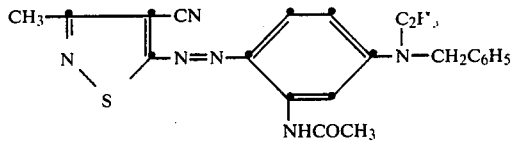

The results indicate that the cellulosic binders of the invention are effective to significantly increase D-max as compared to the control elements with cellulose acetate as the binder.

Example 2

(A) A cyan dye-donor element was prepared by coating on a 6 μm poly(ethylene terephthalate) support a dye layer containing Cyan dye C identified above (0.24 g/m$^2$), duPont DLX-6000 Teflon® polytetrafluoroethylene micropowder (0.016 g/m$^2$), and FC-431® (3M Corp.) surfactant (0.016 g/m$^2$) in a cellulose acetate butyrate binder having the acetyl and butyryl content as shown in Table 2 (0.47 g/m$^2$) coated from an acetone, 2-butanone and cyclopentanone solvent mixture.

On the back side of the dye-donor was coated a slipping layer of the type described and claimed in U.S. Application Ser. No. 813,199 entitled "Slipping Layer For Dye-Donor Element Used In Thermal Dye Transfer", by Vanier and Harrison, filed Dec. 24, 1985.

(B) A yellow dye-donor element was prepared by coating on a 6 μm poly(ethylene terephthalate) support a dye layer containing Yellow dye B identified above (0.27 g/m$^2$), duPont DLX-6000 Teflon® polytetrafluoroethylene micropowder (0.011 g/m$^2$), and FC-431® (3M Corp.) surfactant (0.011 g/m$^2$) in a cellulose acetate butyrate binder having the acetyl and butyryl content as shown in Table 2 (0.32 g/m$^2$) coated from an acetone, 2-butanone and cyclohexanone solvent mixture.

On the back side of the dye-donor was coated a slipping layer of the type described and claimed in U.S. Application Ser. No. 813,199 entitled "Slipping Layer For Dye-Donor Element Used In Thermal Dye Transfer", by Vanier and Harrison, filed Dec. 24, 1985.

(C) A magenta dye-donor element was prepared by coating on a 6 μm poly(ethylene terephthalate) support a dye layer containing Magenta dye A identified above (0.15 g/m$^2$), duPont DLX-6000 Teflon® polytetrafluoroethylene micropowder (0.016 g/m$^2$), and FC-431® (3M Corp.) surfactant (0.011 g/m$^2$) in a cellulose acetate butyrate binder having the acetyl and butyryl content as shown in Table 2 (0.34 g/m$^2$) coated from an acetone, 2-butanone and cyclopentanone solvent mixture.

On the back side of the dye-donor was coated a slipping layer of the type described and claimed in U.S. Application Ser. No. 813,199 entitled "Slipping Layer for Dye-Donor Element Used In Thermal Dye Transfer", by Vanier and Harrison, filed Dec. 24, 1985.

Visual observations were made regarding the tendency for dye crystallization after (a) 16 weeks room keeping (20° C., approximately 45% RH) and (b) 4-week incubation (49° C., 50% RH). The following results were obtained:

TABLE 2

| Dye Donor | Cellulose Acetate Butyrate Acetyl Content (%) | Cellulose Acetate Butyrate Butyryl Content (%) | Crystallization Upon Incubation | Crystallization Upon Room Keeping |
|---|---|---|---|---|
| Cyan (control) | 13 | 37 | Extensive | None |
| Cyan (control) | 5.0 | 50 | Extensive | Extensive |
| Cyan (control) | 2.8 | 50 | Extensive | Minor |
| Cyan | 28 | 19 | None | None |
| Cyan | 21 | 26 | None | None |
| Cyan | 2.0 | 47 | Slight | None |
| Yellow (control) | 13 | 37 | Extensive | Extensive |
| Yellow (control) | 5.0 | 50 | Extensive | Slight |
| Yellow (control) | 2.8 | 50 | Substantial | Substantial |
| Yellow | 28 | 19 | Minor | None |
| Yellow | 21 | 26 | Slight | None |
| Yellow | 2.0 | 47 | Slight | None |
| Magenta (control) | 13 | 37 | Extensive | None |
| Magenta (control) | 5.0 | 50 | Extensive | Substantial |
| Magenta (control) | 2.8 | 50 | Extensive | Minor |
| Magenta | 28 | 19 | None | None |
| Magenta | 21 | 26 | None | None |
| Magenta | 2.0 | 47 | None | None |

Extensive - over 75% of area crystallized
Substantial - about 50% of area crystallized
Slight - less than 25% of area crystallized
Minor - less than 10% of area crystallized The data show that cellulose acetate butyrates having a butyryl content of less than about 35% or an acetyl content of less than about 2% are less likely to promote dye-crystallization when used as binders for thermal dye-transfer, regardless of which dye was used.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon a dye layer comprising a dye dispersed in a binder of cellulose triacetate or a cellulose mixed ester, with the proviso that when the cellulose mixed ester is cellulose acetate butyrate, it has a butyryl content of about 26% or less or an acetyl content of about 2% or less or both.

2. The element of claim 1 wherein the total esterification of said cellulose mixed ester is from about 40 to about 60%, with about 1–30% of said ester being acetyl and about 10–58% being other esterification.

3. The element of claim 1 wherein said cellulose mixed ester is cellulose acetate hydrogen phthalate; cellulose acetate formate; cellulose acetate propionate; cellulose acetate pentanoate; cellulose acetate hexanoate; cellulose acetate heptanoate; cellulose acetate benzoate; or cellulose acetate butyrate having a butyryl content of about 26% or less or an acetyl content of about 2% or less or both.

4. The element of claim 1 wherein said binder is cellulose triacetate, cellulose acetate hydrogen phthalate or cellulose acetate butyrate having a butyryl content of about 26% or less or an acetyl content of about 2% or less or both.

5. The element of claim 1 wherein said dye is a sublimable dye and said cellulose mixed ester is cellulose acetate butyrate having a butyryl content of about 26% or less or an acetyl content of about 2% or less or both.

6. The element of claim 1 wherein the side of the support opposite the side having thereon said dye layer is coated with a slipping layer comprising a lubricating material.

7. The element of claim 1 wherein said support comprises poly(ethylene terephthalate).

8. The element of claim 7 wherein said dye layer comprises sequential repeating areas of cyan, magenta and yellow dye.

9. In a process of forming a dye transfer image comprising imagewise-heating a dye-donor element comprising a support having thereon a dye layer comprising a dye dispersed in a binder and transferring a dye image to a dye-receiving element to form said dye transfer image, the improvement wherein said binder is cellulose triacetate or a cellulose mixed ester, with the proviso that when the cellulose mixed ester is cellulose acetate butyrate, it has a butyryl content of about 26% or less or an acetyl content of about 2% or less or both.

10. The process of claim 9 wherein the total esterification of said cellulose mixed ester is from about 40 to about 60%, with about 1–30% of said ester being acetyl and about 10–58% being other esterification.

11. The process of claim 9 wherein said cellulose mixed ester is cellulose acetate hydrogen phthalate; cellulose acetate formate; cellulose acetate propionate; cellulose acetate pentanoate; cellulose acetate hexanoate; cellulose acetate heptanoate; cellulose acetate benzoate; or cellulose acetate butyrate having a butyryl content of about 26% or less or an acetyl content of about 2% or less or both.

12. The process of claim 9 wherein said support is poly(ethylene terephthalate) which is coated with sequential repeating areas of cyan, magenta and yellow dye, and said process steps are sequentially performed for each color to obtain a three-color dye transfer image.

13. In a thermal dye transfer assemblage comprising:

(a) a dye-donor element comprising a support having thereon a dye layer comprising a dye dispersed in a binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said binder is cellulose triacetate or a cellulose mixed ester, with the proviso that when the cellulose mixed ester is cellulose acetate butyrate, it has a butyryl content of about 26% or less or an acetyl content of about 2% or less or both.

14. The assemblage of claim 13 wherein the total esterification of said cellulose mixed ester is from about 40 to about 60%, with about 1–30% of said ester being acetyl and about 10–58% being other esterification.

15. The assemblage of claim 13 wherein said cellulose mixed ester is cellulose acetate hydrogen phthalate; cellulose acetate formate; cellulose acetate propionate; cellulose acetate pentanoate; cellulose acetate hexanoate; cellulose acetate heptanoate; cellulose acetate benzoate; or cellulose acetate butyrate having a butyryl content of about 26% or less or an acetyl content of about 2% or less or both.

16. The assemblage of claim 13 wherein said binder is cellulose triacetate, cellulose acetate hydrogen phthalate or cellulose acetate butyrate having a butyryl content of about 26% or less or an acetyl content of about 2% or less or both.

17. The assemblage of claim 13 wherein said dye is a sublimable dye and said cellulose mixed ester is cellulose acetate butyrate having a butyryl content of about 26% or less or an acetyl content of about 2% or less or both.

18. The assemblage of claim 13 wherein the side of the support opposite the side having thereon said dye layer is coated with a slipping layer comprising a lubricating material.

19. The assemblage of claim 13 wherein said support of the dye-donor element comprises poly(ethylene terephthalate).

20. The assemblage of claim 19 wherein said dye layer comprises sequential repeating areas of cyan, magenta and yellow dye.

* * * * *